US006062207A

United States Patent [19]

Underhill

[11] Patent Number: 6,062,207

[45] Date of Patent: May 16, 2000

[54] TARGET TRAP FOOT OPERATED COCKING AND RELEASING DEVICE

[76] Inventor: Clinton James Underhill, P.O. Box 939, Berry Creek, Calif. 95916

[21] Appl. No.: 08/865,215

[22] Filed: May 29, 1997

Related U.S. Application Data

[60] Provisional application No. 60/018,381, May 29, 1996.

[51] Int. Cl.[7] ..... F41J 9/22

[52] U.S. Cl. ..... 124/8

[58] Field of Search ..... 124/8

[56] References Cited

U.S. PATENT DOCUMENTS

| | | | |
|---|---|---|---|
| 2,193,266 | 3/1940 | Betts | 124/8 |
| 3,533,392 | 10/1970 | Luebkeman | 124/8 X |
| 3,601,112 | 8/1971 | Dale | 124/8 |
| 3,880,135 | 4/1975 | Martin | 124/8 |
| 3,924,600 | 12/1975 | Luebkeman | 124/8 X |
| 3,951,125 | 4/1976 | Dixon | 124/8 |
| 4,481,932 | 11/1984 | Olson | 124/8 |
| 5,605,139 | 2/1997 | Orwoll | 124/8 |

*Primary Examiner*—John A. Ricci

[57] ABSTRACT

A clay target launcher designed to be operated by a single person during target practice includes a base with a rotatable launching arm mounted thereon, which accommodates a clay target, a trigger to latch the arm in a cocked position and movable to release the arm, and a foot pedal. A spring is mounted between the foot pedal and the throwing arm to apply rotational bias to the arm, and a trigger release actuator is attached between the foot pedal and the trigger. When the foot pedal is in its upper position, the spring is not tensioned, so there is no danger of accidentally releasing the target. When the user is ready to release a target, he depresses the pedal with his foot, thus tensioning the spring. When the pedal is fully depressed, the trigger release actuator is effective to move the trigger to allow the throwing arm to rotate and launch the target.

1 Claim, 5 Drawing Sheets

TARGET TRAP FOOT OPERATED COCKING AND RELEASING DEVICE

CROSS-REFERENCE TO RELATED APPLICATIONS

This application claims priority from U.S. provisional application Ser. No. 60/018,381 filed on May 29, 1996.

BACKGROUND OF THE INVENTION

1. Field of the Invention

This invention relates to Target Throwing Machines, specifically for Cocking and Releasing of the Target Trap Throwing Arm.

2. Description of the Prior Art

Target Throwing Machines are used in shotgun sports to throw targets in the air for practice and competition. Related Prior Art shows a variety of ways these machines are operated. These portable, manually operated machines are made to be cocked into a loaded position by using a persons hand and arm strength. While some machines have ways to release the cocked throwing arm with the users foot, all are cocked with the users hands. After cocking the high powered throwing arm, it would be possible if left unattended for someone other than the original user to accidentally trigger the machine. The hand cocking design also brings the users upper body, head, and hands into close range of the high powered throwing arm, increasing the possibility of injury.

SUMMARY OF THE INVENTION

Therefore, in practicing my invention, I provide a spring loaded target trap that can be cocked and triggered to discharge a clay target. The present Invention solves the problems mentioned in the Related Prior Art, by providing a safe, hands free, foot operated cocking and releasing device for the Target Throwing Machine. By means of a strategically mounted cocking lever in which the main spring and the release lever are attached, the device provides a safe usable height for the foot pedal on the cocking lever, the variable adjustment of the throwing arm, and the variable adjustment of the release lever. This foot operated cocking device is much safer since it is designed to operate only when the user is in a safe position behind the machine. Also the Target Throwing Arm is not cocked or released until the very moment the user is ready to shoot. For a better understanding of the Invention and its advantages reference should be had to the drawings and to the description of the preferred embodiment of the Invention.

DESCRIPTION OF THE PREFERRED EMBODIMENT

Figure 1:
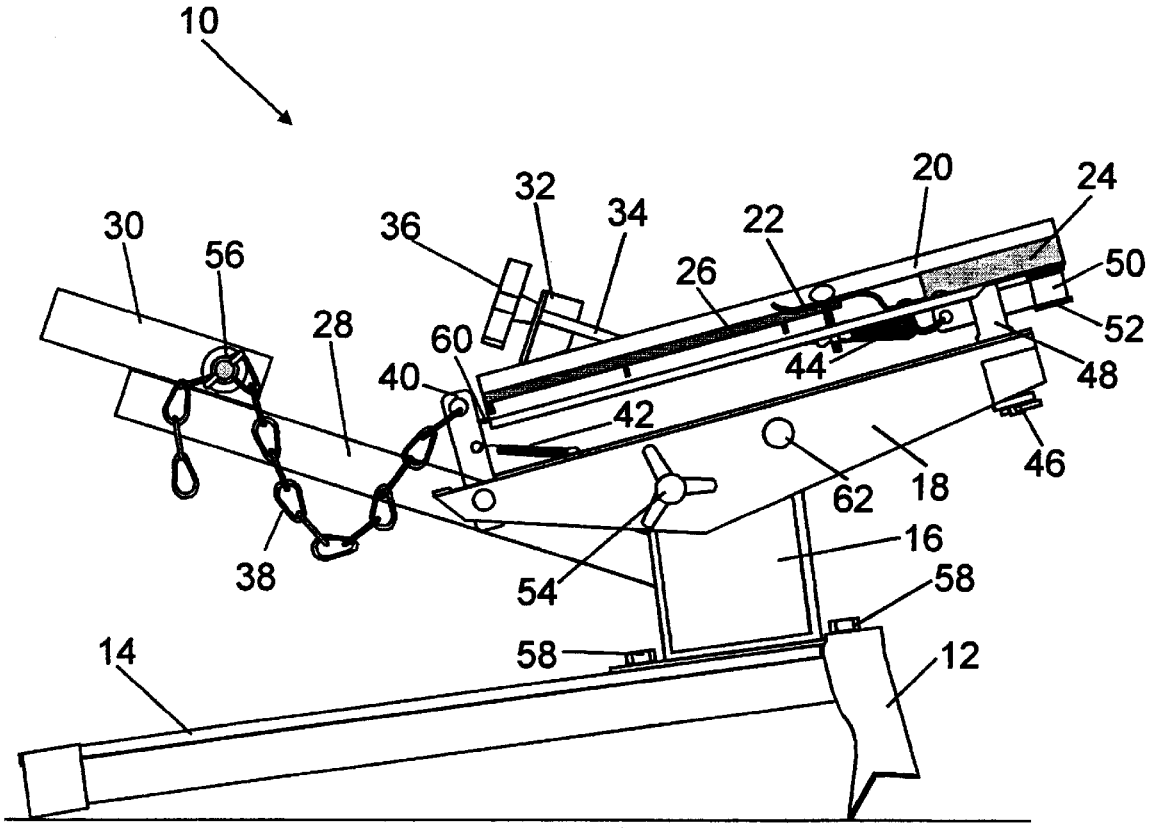
FIG. 1 is a right side view of the target throwing machine.
Figure 2:
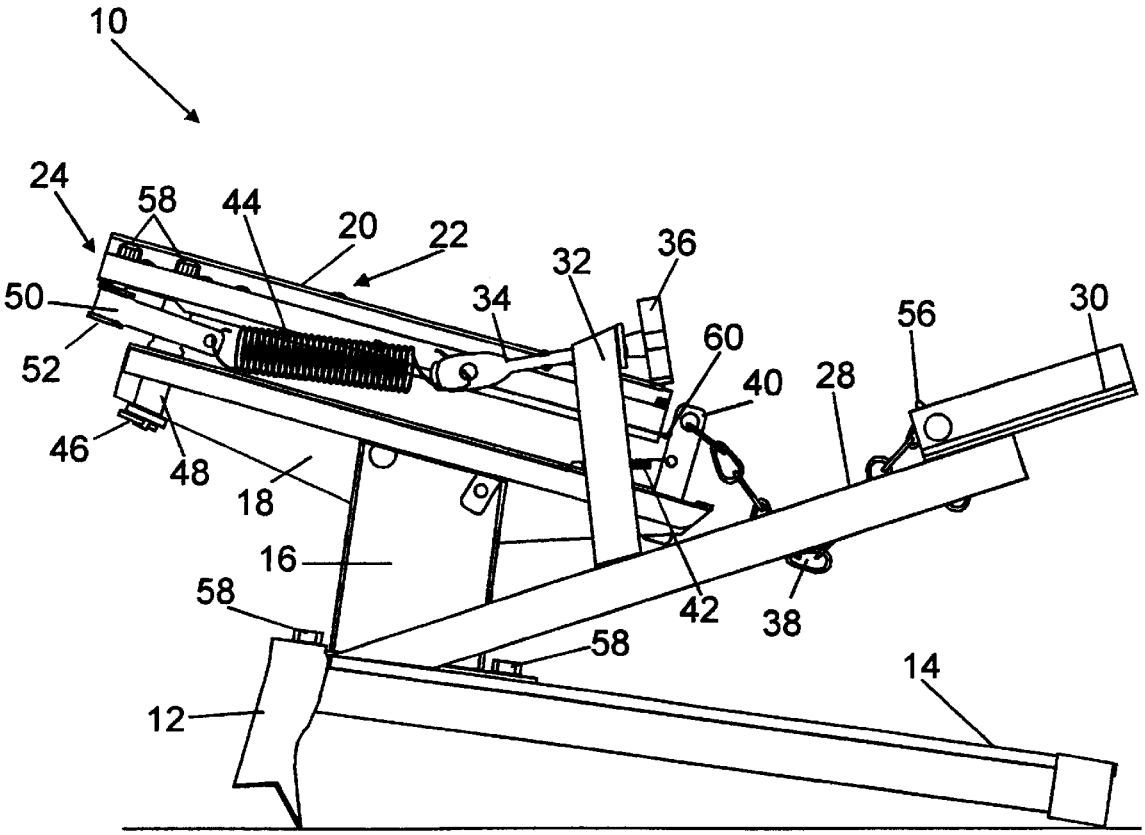
FIG. 2 is a left side view of the target throwing machine.
Figure 3:
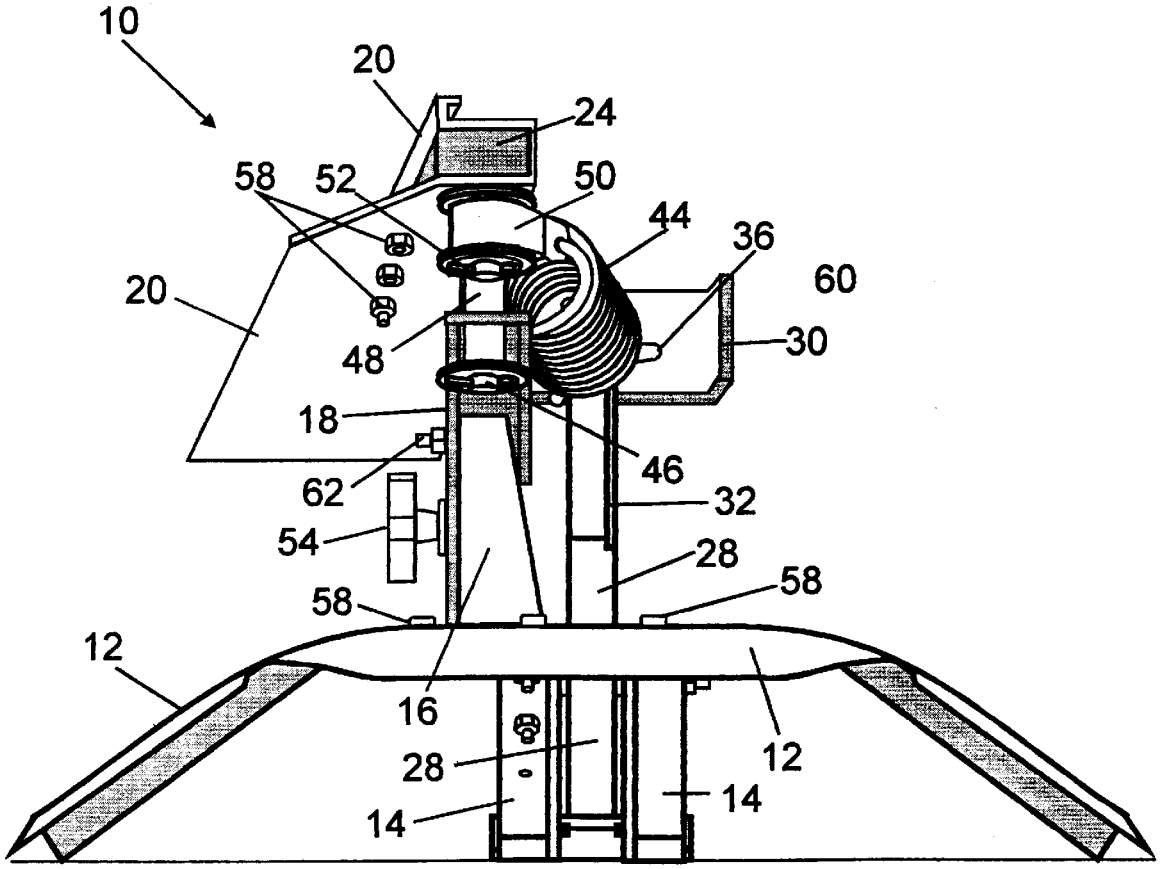
FIG. 3 is a front view of the target throwing machine.
Figure 4:
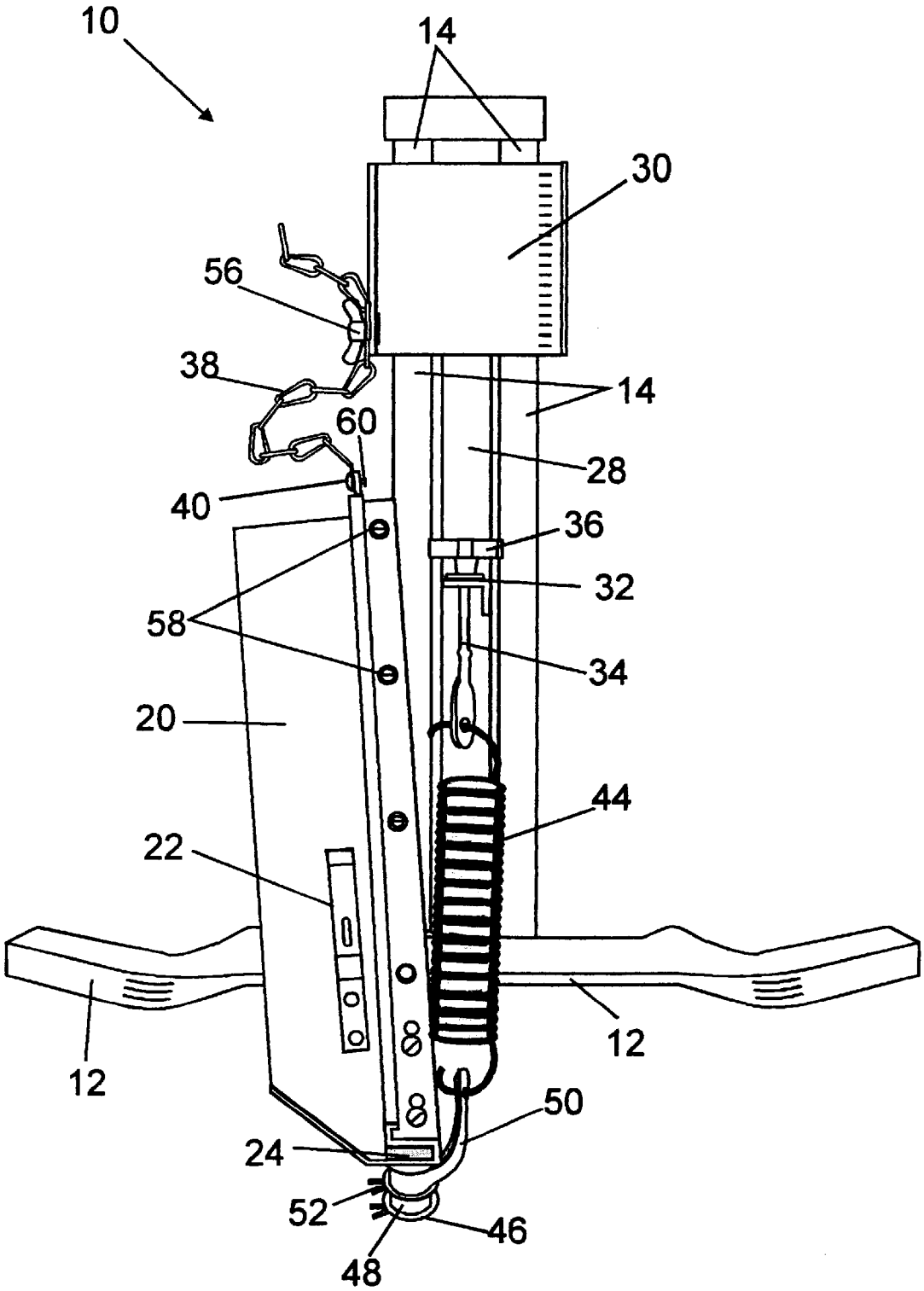
FIG. 4 is a top plan view of the target throwing machine showing the throwing arm in the latched position, not yet cocked.
Figure 5:
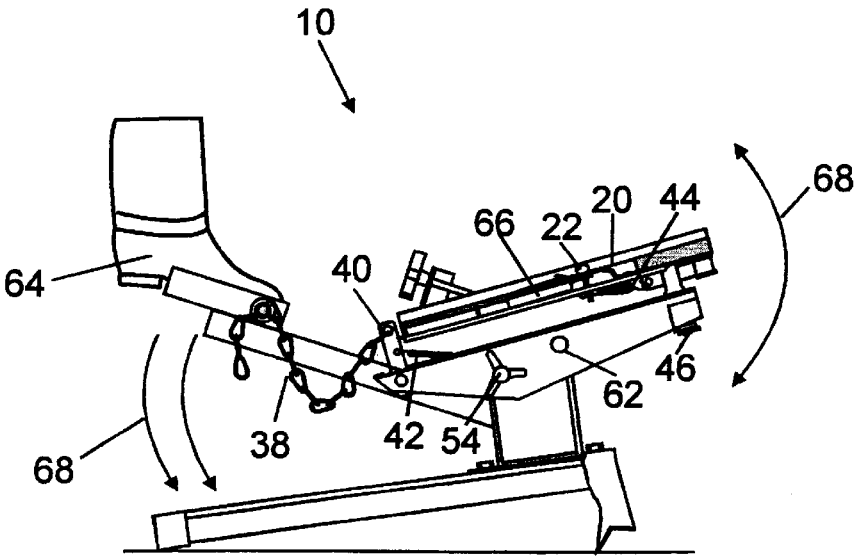
FIG. 5 is a side view showing the user's foot in position before cocking and releasing the target.
Figure 6:
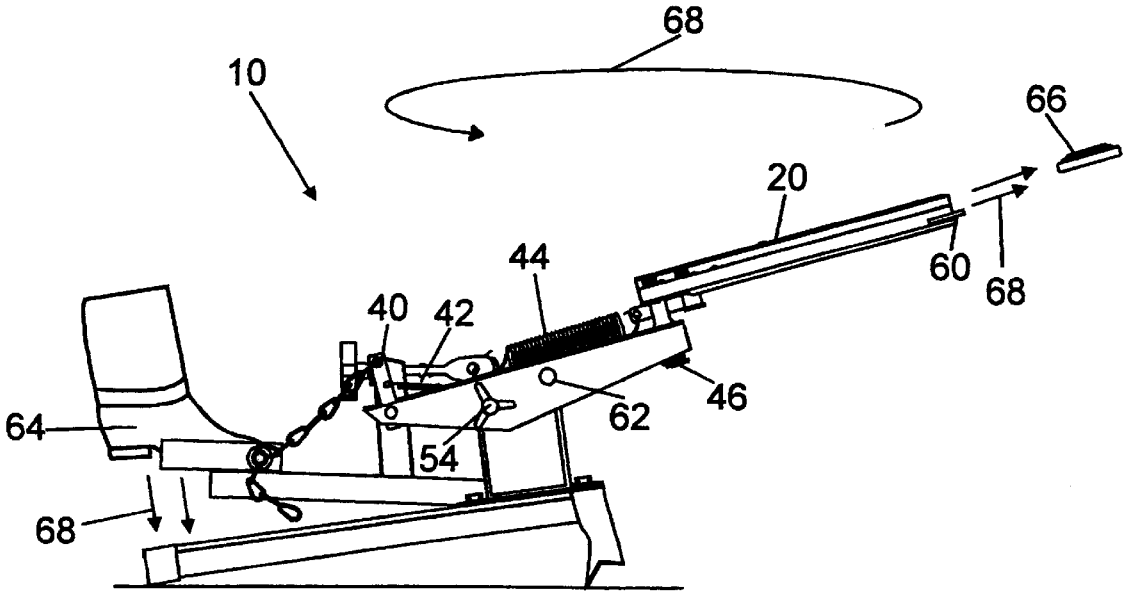
FIG. 6 shows the user's foot pressing down, to cock and release the target into the air.

Referring now to the drawings where the invention generally is designated invention 10. FIGS. 1, 2, 3, and 4 show invention 10 in various views. The numbered parts include: The invention in general, invention 10. Invention 10 has front stabilizer leg frame 12 as a frontal ground support and rear support frame 14 on the ground at the rear. Leg frame 12 and support frame 14 provide three-point ground contact support for invention 10. Rectangular base 16 towards leg frame 12 on support frame 14 has triangular frame 18 pivotally attached. Triangular frame 18 is adjustable so that arm assembly 20 can be angled upward and downward. High angle clip 22 is the holder for clay targets 66 (See FIG. 5). Spacer 24 is at the front of arm 20 and rubber strip 26 runs along under the collar on top of arm 20. Pedal arm 28 is pivotally fastened to support frame 14 below base 16 and has pedal 30 on top at the rear terminal end. Eye bolt support arm 32 is affixed to pedal arm 28 as a support for eye bolt assembly 34 and has tension adjust knob 36 on an extended end. Trigger release connection 38 is affixed adjustably to pedal 30 and to trigger arm 40 in a manner to pull trigger arm 40 free of trigger catch 60 and release the end of arm assembly 20 when foot pedal 30 is pushed down. Trigger arm 40 is pulled back to relatch arm 20 by trigger spring 42. Main spring 44 is the powering source to make arm assembly 20 operate as a throwing arm to discharge clay target 66 (FIGS. 5 and 6). Pivotal rod 46 is the hinging device that allows arm assembly 20 to swing free when triggered. Pivotal rod 46 operates in pivotal rod housing 48. Main spring 44 is fastened to spring hook 50 at the front. Spring hook rod 52 affixes spring hook 50 to the front section of arm assemblage 20. Elevation adjust knob 54 allows triangular frame assemblage 18 to be changed to different throw angles on pivotal bolt 62. Trigger release connector 38 is affixed to pedal 30 by fastner 56 in a manner allowing trigger release connector 38 to be adjusted for different firing settings. Parts retainers 58 (nuts, bolt heads, etc.) indicate the various fittings that retain solid parts and operational parts of invention 10.

FIGS. 5 and 6 illustrate invention 10 in use. In FIG. 5, user's foot is in the raised position on pedal 30 ready to push down as indicated by movement arrows 68. Clay target 66 is loaded on arm 20 in high angle clip 22. In FIG. 6, user's foot has pushed pedal 30 down, arm 20 has swung around (movement arrow 68), and clay target 66 is in flight. As illustrated in FIGS. 5 and 6, user's foot 64 operates invention 10. For this reason a single shooter can both operate the device of invention 10 and have his hands free to aim and fire his gun at clay target 66.

Although I have described a preferred embodiment of my invention in the above specification and illustrated it in the drawings, I reserve the right to make changes in the design and structure of the invention that fall within the scope of my appended claims. I also reserve the right to restrict others from claiming invention on a changed end product when the changes or the end product falls within the scope of my claims.

What is claimed is:

1. A target throwing machine, comprising:

(a) a base;

(b) a target throwing arm rotatably mounted on the base for rotation between a cocked position and a released position;

(c) a trigger arm, the trigger arm movable between a holding position in which it prevents the target throwing arm from rotating from its cocked position to its released position, and a firing position in which the target throwing arm is allowed to rotate from its cocked position to its released position;

(d) a spring having two ends, for applying rotational bias to the target throwing arm from the cocked position toward the released position;

(e) a pedal arm adapted to be depressed by a user's foot, attached to the base for movement between an upper position and a depressed position;

(f) one end of the spring attached to the target throwing arm, and the other end of the spring attached to the pedal arm, such that movement of the pedal arm from the upper position toward the depressed position will tension the spring;

(g) a trigger release actuator attached between the trigger arm and the pedal arm, the trigger release actuator effective to move the trigger arm from the holding position to the firing position only when the pedal arm is moved fully from the upper position to the depressed position;

(h) whereby, in preparation for throwing a target, the target is placed on the target throwing arm, and the target throwing arm is moved to its cocked position and the trigger arm is moved to its holding position to hold the target throwing arm in its cocked position, and the spring is not tensioned; and (i) whereby to throw a target, a user applies force to the pedal arm to move the pedal arm from its upper position toward its depressed position, which adds tension to the spring, and when the pedal arm reaches its depressed position, the trigger arm is moved by the trigger release actuator to its firing position, which releases the target throwing arm to quickly move to its released position under bias from the spring, thus throwing the target.

* * * * *